United States Patent [19]

Groner

[11] 4,130,359

[45] Dec. 19, 1978

[54] ELECTROPHORETIC MIGRATION IMAGING APPARATUS AND METHOD UTILIZING ENLARGED MIGRATION ENVIRONMENT

[75] Inventor: Carl F. Groner, Rochester, N.Y.

[73] Assignee: Eastman Kodak Company, Rochester, N.Y.

[21] Appl. No.: 805,217

[22] Filed: Jun. 9, 1977

Related U.S. Application Data

[63] Continuation-in-part of Ser. No. 708,243, Jul. 23, 1976, abandoned.

[51] Int. Cl.[2] ..... G03G 15/00

[52] U.S. Cl. ..... 355/3 P; 96/1 PE; 96/1.3; 204/300 R; 355/4

[58] Field of Search ..... 355/3 P, 4; 96/1 PE, 96/1.2, 1.3; 204/180 R, 299 PE, 300 PE, 181 PE

[56] References Cited

U.S. PATENT DOCUMENTS

| | | | |
|---|---|---|---|
| 3,474,019 | 10/1969 | Krieger et al. | 204/181 PE |
| 3,551,320 | 12/1970 | Krieger et al. | 204/181 PE |
| 3,616,391 | 10/1971 | Zucker | 204/181 PE |
| 3,642,606 | 2/1972 | Zucker | 204/300 PE |
| 3,647,660 | 5/1972 | Wells | 204/181 PE |
| 3,649,514 | 3/1972 | Rosenberg | 204/299 PE |
| 3,666,472 | 5/1972 | Till et al. | 204/181 PE |
| 3,674,475 | 7/1972 | Silverberg | 204/181 PE |
| 3,697,407 | 10/1972 | Cagnina et al. | 204/181 PE |
| 3,708,286 | 1/1973 | Davies | 204/181 PE |

*Primary Examiner*—Richard L. Moses
*Attorney, Agent, or Firm*—John D. Husser

[57] ABSTRACT

Electrophoretic migration imaging apparatus and method of the type using electrophotosensitive pigment particles are improved, e.g., as to image density and background, by providing an enlarged migration environment for the imaged electrode. In one embodiment the non-imaged electrode and pigment dispersion thereon are moved predeterminedly, in direction and rate, so as to supplant non-imaged electrode surface and dispersion presented to imaged electrode portions during each successive imaging sequence.

23 Claims, 11 Drawing Figures

PRIOR ART

FIG. 5
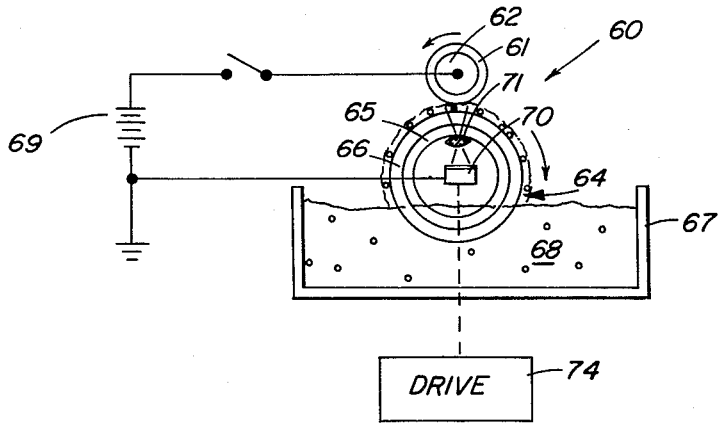
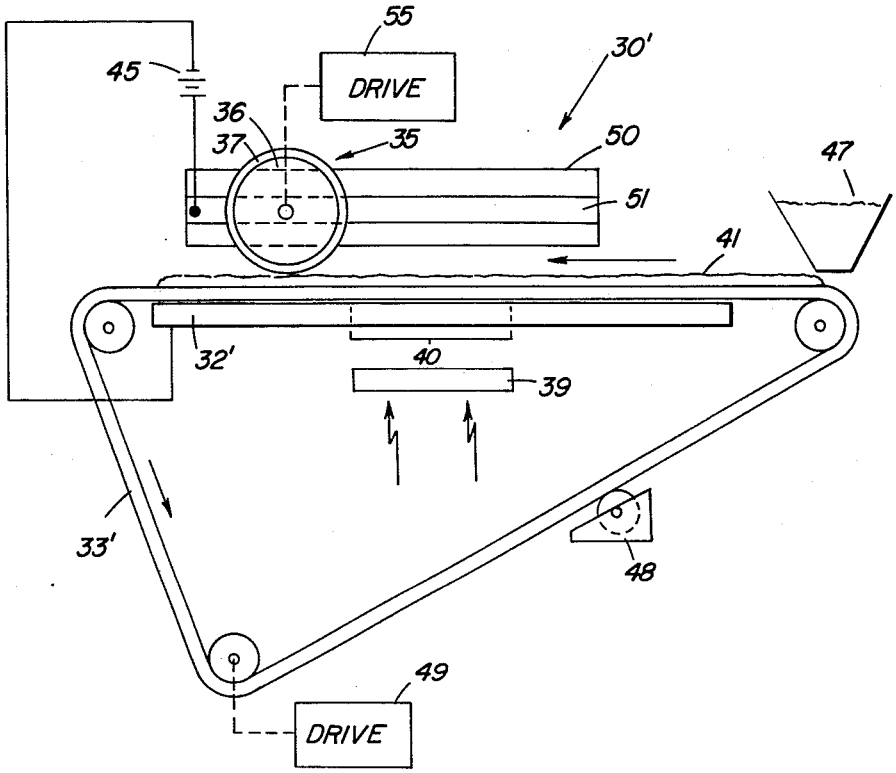
FIG. 6

FIG. 7
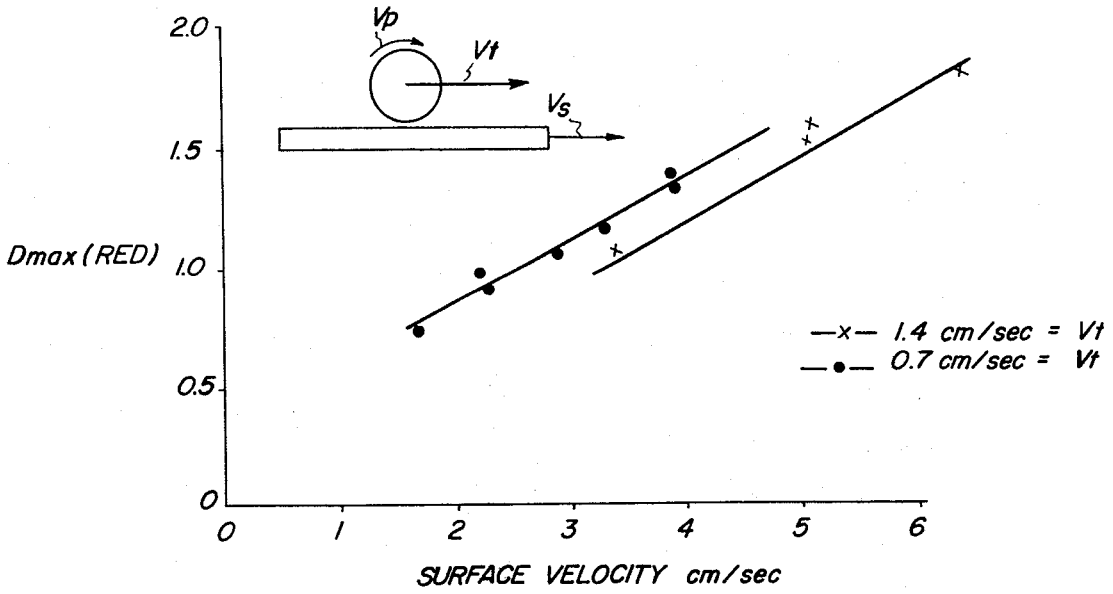
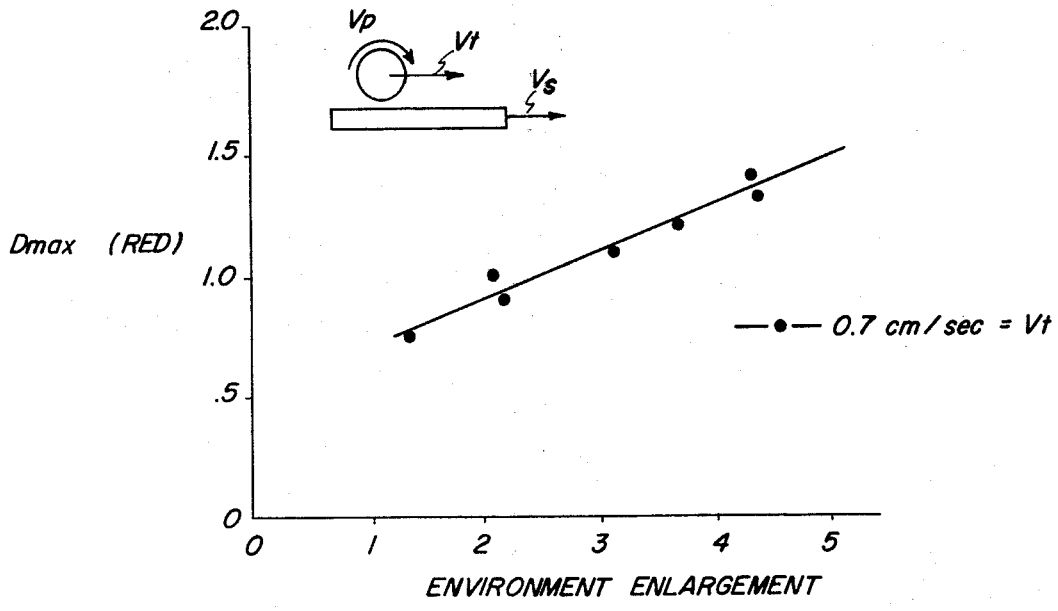
FIG. 8

FIG. 10
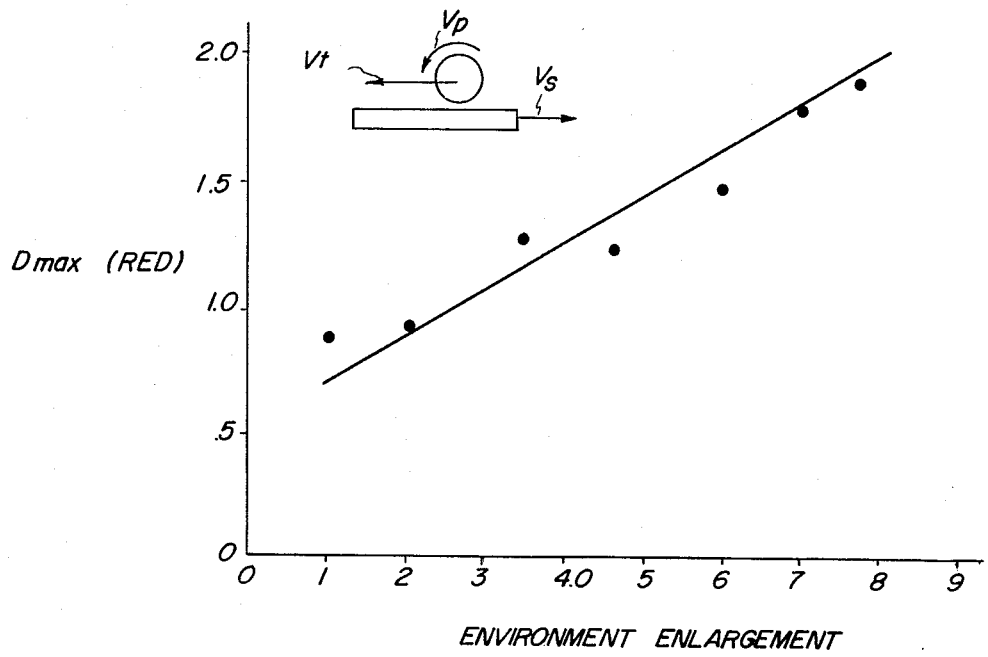
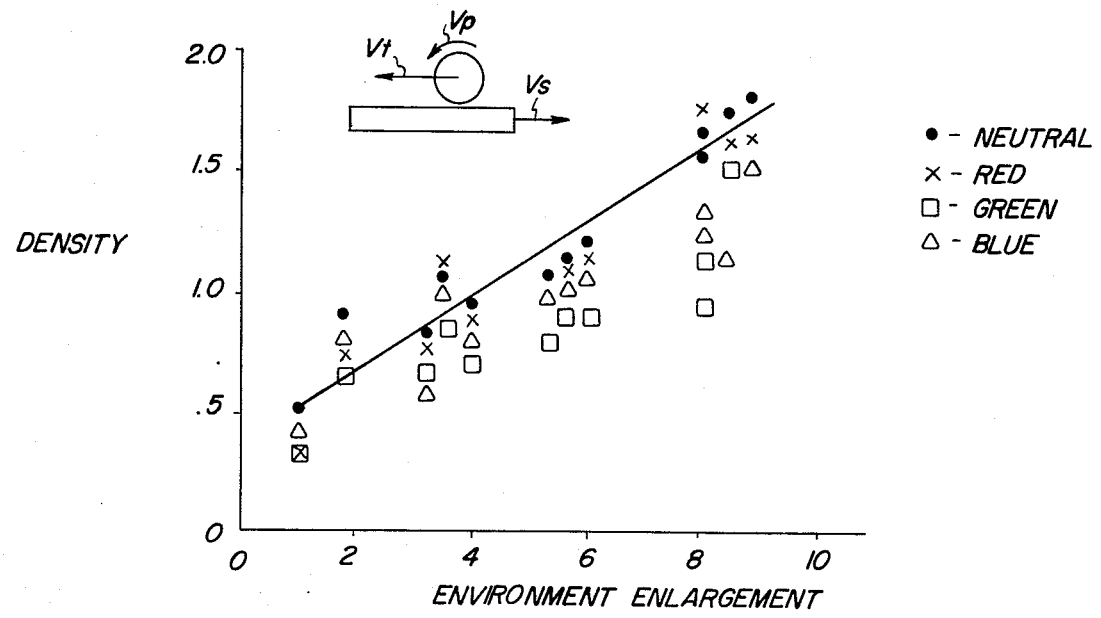
FIG. 9

ELECTROPHORETIC MIGRATION IMAGING APPARATUS AND METHOD UTILIZING ENLARGED MIGRATION ENVIRONMENT

CROSS-REFERENCE TO RELATED APPLICATIONS

This application is a Continuation-in-Part application of my earlier filed application Ser. No. 708,243, filed July 23, 1976 now abandoned.

BACKGROUND OF THE INVENTION

1. Field of the Invention

The present invention relates to improved apparatus and procedures for electrophoretic migration imaging systems which use electrophotosensitive marking particles and more specifically to means and techniques for improving the quality of images produced by such systems.

2. Background of the Invention

Electrophoretic migration imaging processes capable of producing monochromatic or polychromatic images have been extensively described in the patent literature. Early publication of these processes occurred in a series of patents by E. K. Kaprelian including U.S. Pat. No. 2,940,847 issued June 14, 1960; U.S. Pat. No. 3,100,426 issued Aug. 13, 1963; U.S. Pat. No. 3,140,175 issued July 7, 1964 and U.S. Pat. No. 3,143,508 issued Aug. 4, 1964. More recent publications relating to polychromatic, electrophoretic migration imaging processes include U.S. Pat. No. 3,383,393 to Yeh issued May 21, 1968; U.S. Pat. No. 3,384,565 to Tulagin and Carriera issued May 21, 1968 and U.S. Pat. No. 3,384,566 to Clark issued May 21, 1968.

In a typical embodiment of a single-pass, polychromatic, electrophoretic migration imaging system, images are formed by providing a suspension of electrically photosensitive particles of three different color types (each type of particle being sensitive uniquely to a particular color of light) between a transparent, electrically conductive electrode (commonly termed the "injecting electrode") and an electrode bearing an electrically insulating layer on its outer surface (commonly termed the "blocking electrode"). An electric field is applied across the two electrodes while simultaneously exposing the particles to multicolor light image which is selectively absorbed by the particles according to light color.

As these steps are completed, selective particle migration takes place in image configuration producing complimentary images on both electrodes. While the theory of image formation is not completely understood, it is believed that the particles initially bear a charge in the imaging suspension which causes them to be attracted to the injecting electrode upon application of the electric field between the blocking and injecting electrodes. Upon exposure to activating electromagnetic radiation to which they are sensitive (i.e., of a color absorbed), the exposed particles adjacent the injecting electrode apparently undergo a change in charge polarity by exchanging charge with the injecting electrode. These particles, now bearing the same charge polarity as the injecting electrode, are repelled by it and migrate to the blocking electrode. The particles which migrate to the blocking electrode are less able to exchange charge with that electrode's insulating layer and do not therefore readily recycle to the injecting electrode. As a result, an image is formed by particle subtraction on the injecting electrode, such image being typically a photographically positive image, and a complimentary image, typically a negative or reversal image, is formed on the blocking electrode. Electrophoretic migration imaging systems of the type described above are commonly referred to as PhotoElectroPhoretic processes or denoted by the acronym PEP processes.

In U.S. Pat. No. 3,976,485 another approach is disclosed wherein electrically photosensitive particles, disposed between two spaced electrodes having predetermined properties are subjected to an electric field and imagewise exposed to activating electromagnetic radiation and image formation is achieved by immobilizing at least a portion of the exposed photosensitive particles and causing at least a portion of the unexposed particles to undergo a net change in charge polarity. In this approach, termed photoimmobilized electrophoretic recording (PIER), one of the two spaced electrodes has its surface adjacent the photosensitive particles bearing an amount of a dark charge exchange material which provides a net change in charge polarity of photosensitive particles coming in electrical contact therewith in the presence of a field and in the absence of activating radiation. (This surface is sometimes referred to hereinafter as a dark charge exchange layer). The other spaced electrode advantageously may have on its surface adjacent the photosensitive particles, a "blocking" layer, i.e., a layer which under normal process imaging conditions exhibits minimal charge exchange capability with either the exposed or unexposed electrically photosensitive particles.

In accord with various useful embodiments of either of the above-described approaches, the electrically photosensitive particles can be disposed between the spaced electrodes in a liquid imaging suspension comprising an electrically insulating liquid. Upon being admixed in such a liquid, the particles acquire an electrostatic charge of a positive or negative polarity, although it is not uncommon for the imaging suspension to contain a mixture of both positive and negative polarity particles.

In connection with the various known embodiments of the above-described PEP processes, it has been proposed, at one time or another, to modify the customary surface characteristics of the so-called "injecting" electrode and/or the "blocking" electrode. For example, in British Pat. No. 1,193,276 published May 28, 1970 in examples V-IX thereof it is proposed to coat extremely small amounts of a "Lewis base" or a "Lewis acid", such as 2,4,7-trinitro-9-fluorenone, on one or the other of the electrode surfaces used in PEP processes to increase the photographic speed of the PEP process. Similarly, in British Pat. No. 1,347,162 published Feb. 20, 1974 it is proposed to coat a photoconductive layer on the surface of a PEP injecting electrode in an attempt to modify various imaging characteristics of conventional PEP processes, such as photographic speed, $D_{max.}$, $D_{min.}$, image contrast, and spectral sensitivity. In Weigl, U.S. Pat. No. 3,616,390 issued Oct. 26, 1971 and Weigl U.S. Pat. No. 3,723,288 issued Mar. 27, 1973 it is proposed to use as a conductive injecting electrode a preilluminated photoconductive zinc oxide-binder coating applied to a conductive substrate. In Weigl, U.S. Pat. No. 3,595,771 issued July 27, 1971, it is proposed to use as the "blocking electrode" of a PEP process a photoconductive insulating coating such as a "charge transfer complex" of a non-photoconductive aromatic polycarbonate polymer and a "Lewis acid", such as 2,4,7-trinitro-9-fluorenone, in an effort to remove accumulated electrostatic charge which may build up on a conventional highly insulating blocking electrode. In Ota and Ota et al, U.S. Pat. Nos. 3,689,399 and 3,689,400 issued Sept. 5, 1972 it is suggested that one can coat an insulating layer on the "injecting" electrode as well as the "blocking" electrode of a PEP image display device. In addition, in British Pat. No. 1,341,690 published Dec. 28, 1971 it is proposed to coat on the surface of an injecting electrode of a PEP process a photoconductive layer, an electroluminescent layer over the photoconductive layer, and a transparent conducting layer over the electroluminescent layer so that exposure may be effected by using the photoconductive layer to selectively energize the electroluminescent layer which in turn emits radiation to expose the image-forming electrically photosensitive particles used in the process.

However, with regard to all of the above-described processes, difficulty has existed in obtaining sufficiently high density in the image formed for utilization, that is, in causing a sufficient quantity of the photosensitive pigment particles to migrate in the desired image pattern onto the utilized electrode surface (the electrode surface on which the subsequently used image pattern is formed).

The exact cause(s) of this difficulty have not been definitely determined; however, certain prior art teachings theorize regarding them and propose improvement solutions based on those theories.

For example, the disclosure of U.S. Pat. No. Re. 28,260 proceeds on the assumption that some particles, bearing charge causing them to be attracted to the injecting electrode, do not obtain a sufficient charge exchange upon exposure and thus remain on the injecting electrode due to small forces bonding the particles to that electrode surface, e.g., Van der Waal's forces. The solution proposed is to provide means for creating a dynamic stress on the weakly retained particles to free them for migration. It is noted that the dynamic stress can be created by a differential linear velocity between a rolling and plate electrode at their imaging interface, and that the velocity differential should not exceed 10% of the velocity at which rolling electrode translates.

U.S. Pat. No. 3,595,772 theorizes that multicolor pigment particles of such imaging suspensions agglomerate and that the inactivated particles of the bound together mass restrain the activated particles therein from desired image migration. The solution proposed is to prestress the suspension to break up the agglomerates.

U.S. Pat. Nos. 3,616,395; 3,737,310; 3,645,874 and 3,850,627 propose improvement of the process by precharging the image suspension to make the particles unipolar and/or to concentrate the particles near the injecting electrode surface prior to the imaging operation.

U.S. Pat. Nos. 3,676,313 and 3,477,934 disclose techniques for precharging the suspension on one of the electrodes to enhance the migration field or neutralize charge which accumulates on one of the electrodes in a continuous operation apparatus.

U.S. Pat. No. 3,595,771 likewise is aimed towards elimination of residual charge (from a previous imaging operation) on an electrode and suggest constructing the electrode of photoconductive insulative material and flood exposing it between imaging sequences.

Thus it is evident there has been a general realization that image quality of photoelectrophoretic migration imaging process could desirably be improved, particularly as to resultant image density, and that a wide variety of specific techniques for obtaining such improvement have been proposed.

SUMMARY OF THE INVENTION

The present invention likewise is aimed toward the improvement of image quality in such processes and involves unique approach, procedure and apparatus for providing such improvement.

It is therefore a general objective of the present invention to provide improved procedure and apparatus for photoelectrophoretic migration imaging.

Another, more specific objective, is to provide apparatus and methods for facilitating improved density and background in an image resulting from such migration imaging processes.

The above and other desirable results and features are achieved in accordance with the present invention by the provision of methods and means for providing an improved operating environment for the imaged electrode of photoelectrophoretic migration imaging apparatus. The term "imaged electrode" as utilized above and throughout this application refers to the surface on which marking particles are accumulated for producing the image to be used. The operating environment to which the imaged electrode is subjected includes the imaging suspension and the non-imaged electrode. The present invention, in one important aspect, improves the operating environment by increasing the quantity of marking particles presented to the development zone during each of the successive stages of in imaging sequence. In accordance with another important aspect the non-imaged electrode surface, initially presented to the image electrode is supplanted during each of the successive imaging sequence. In accordance with another important aspect, light-activated particles which have been attracted to the non-imaged electrode are removed from the imaging zone before further charge exchange and subsequent backmigration to the image electrode can occur, thus eliminating their potential adverse effect as background on the image electrode. The above aspects are accomplished in accordance with one embodiment of the present invention by providing a layer containing a controlled amount of imaging dispersion between the imaged and the non-imaged electrode surfaces and controlling the relative movement of the imaged and non-imaged electrodes, during imaging, to provide a substantially enlarged migration environment to the imaged electrode. In this application enlargement of migration environment refers to the ratio of the non-imaged electrode surface presented at the imaging zone during a complete development cycle to the imaged electrode surface presented at the imaging zone during that cycle. For example, in accordance with this terminology the enlargement of prior art apparatus would be substantially one (1.0).

BRIEF DESCRIPTION OF THE DRAWINGS

Embodiments of the invention are hereinafter described with reference to the attached drawings which form a part hereof and in which:

FIG. 5 is a schematic side view of another apparatus embodiment for practice of the present invention;

FIG. 6 is a schematic side view of another apparatus for practice of the present invention;

FIG. 7 is a graph indicating results of a test described in Example III;

FIG. 8 is a graph indicating results of another test described in Example III;

FIG. 9 is a graph indicating the results of the test described in Example IV;

FIG. 10 is a graph indicating the results of the test described in Example V.

DETAILED DESCRIPTION OF THE PREFERRED EMBODIMENTS

Figure 1:
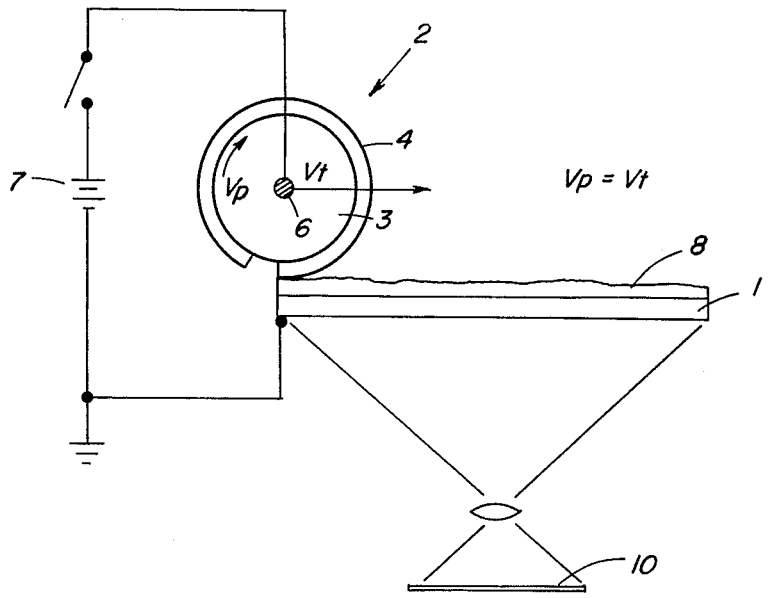
FIG. 1 is a schematic side view of exemplary prior art apparatus for photoelectrophoretic migration imaging.

Before undertaking explanation of various embodiments of the present invention, a slightly enlarged explanation of the prior art on which it improves, is believed appropriate. FIG. 1 illustrates a representative prior art device for implementation of photoelectrophoretic migration imaging. That device comprises a charge exchange electrode 1 and an image receiver electrode 2 which includes a conductive roller 3 and an electrically insulative layer 4, it being assumed for our purposes that the layer 4 can be the copy sheet to be utilized. As illustrated electrode 2 is mounted for rotation about axis 6 and for translation in rolling contact across electrode 1. An electrical potential is provided by source 7 between the electrodes and as electrode 2 rolls across electrode 1 a migration inducing field is created across the gap between the proximate surfaces thereof. A photoelectrophoretic dispersion 8 is coated on electrode 1 and can comprise electrophotosensitive pigment particles dispersed in an insulative carrier liquid. A light image of an original 10 to be reproduced is in focus at the plane of the dispersion in registration with the path over which the insulative layer 4 will pass. The electrode 1 is substantially light transparent. Thus as the electrode 2 transverses electrode 1, pigment particles within the development gap between the electrodes are believed to become charged and thus attracted to charge exchange electrode 1. At the charge exchange electrode the exposed particles change their polarity of charge and migrate to the oppositely biased insulative layer 4. The imaging sense (i.e., direct or reverse) of the image on layers 4 (and 1) will depend on the mode of such migration imaging utilized. That is, if a conventional PEP system is utilized, a reverse sense image will form at electrode 4 with exposed particles migrating thereto. If a PIER system is utilized, the image on layer 4 will be direct in image sense, with unexposed particles migrating thereto. As indicated in FIG. 1, an essential feature of prior art devices is that the velocity Vp of the peripheral surface of layer 4 is equal to the translational velocity Vt of the electrode 2 and in a direction so that the relative velocity between surface 4 and the image of 10, at the traveling contact zone between electrodes, is zero, i.e., no slipping occurs between the contacting electrode surfaces. Various other optical arrangements have and can be implemented including e.g., scanning a moving image at a rotating, but non-translating, electrode nip, or translating the electrode 1 with an image supported thereon past a rotating, but non-translating roller. The critical constraint is that there be a substantially zero relative velocity between the light image and the imaged electrode to obtain a sharp registration of the image to be reproduced. This result can be obtained in a variety of ways other than those mentioned above. However, as noted regarding FIG. 1, heretofore it has also been presumed that there should exist an additional constraint, viz. a minimum, or zero, relative velocity between the electrode surfaces during imaging. Thus the enlargement of the migration environment is substantially 1.0 according to the definition set forth above. As previously noted, above, the teachings of U.S. Pat. No. Re. 28,260 indicate that a slight relative velocity may desirably exist between the electrodes (to induce dynamic stress on particles); however, the caveat is provided that the relative velocity should not exceed 10% of the traversing velocity of the roller to avoid image destruction.

Figure 2:
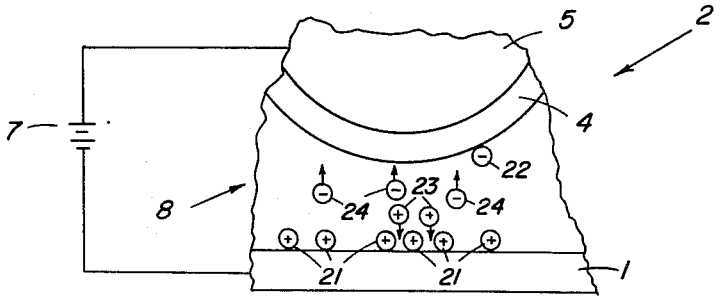
FIG. 2 is an enlarged schematic view of the imaging zone of apparatus such as shown in FIG. 1.

FIG. 2 is an enlarged schematic view of a portion of the interface zone, or development gap, of the electrodes 1 and 2 of the FIG. 1 device and is provided to illustrate phenomena which I theorize to exist under operation in such prior art devices. In FIG. 2 it is assumed that all particles exhibit a positive polarity charge in the dispersion 8 and thus migrate to charge exchange electrode 1 because of the electrostatic force of attraction between the positively charged particles and negatively biased charge exchange electrode. Particles 21 exemplify those particles which remain on charge exchange electrode 1 (if assuming a PEP process) because they have not been activated by exposure to radiation of wavelength to which they are sensitive (e.g., magenta and cyan particles during exposure to a blue image light). Particles 22 represent a particle which has moved to electrode 1, exchanged charge and migrated substantially to electrode 2 (e.g., a yellow pigment exposed to the blue image light). It will be noted that at this stage of completion of the process for the illustrated image portion, a substantial quantity of positive polarity pigment remains very closely proximate the electrode 1. In actuality many more particles are involved; and the number of particles shown in particular states are not intended to be directly proportional to the actual results. However, the differently numbered particles are representative of different effects I theorize to be present; and, in this regard, it is significant to note particularly particles 23 and 24 which are assumed to be yellow pigments. Particles 23 are shown bearing a positive electrostatic charge and thus being attracted toward electrode 1, where they should exchange charge and migrate to electrode 2. However, it is theorized that one or more effects may limit this and control or prevent increased migration and density. First, the accumulation of unactivated particles 21 may present an electrical barrier between the charge exchange electrode and exposed particles and thus prevent or reduce charge exchange by particles 23. Secondly, the accumulation of particles 21 may present an optical barrier or scattering layer which deters efficient activation of the particles 23.

Let us consider now particles 24 which also are assumed to be yellow ones that have been blue-light activated, exchanged charged at electrode 1 and commence migration to electrode 2. I theorize also that one or more effects may deter efficient migration of these particles. For example, the accumulation of positively charged particles at electrode 1 and negatively charged particles (migrated) at electrode 2, as the process progresses decreases the net electric field which propels the negatively-charged particles to the image electrode. Thus migration is reduced. It will be appreciated that the illustration of FIG. 2 is at one intermediate stage of the mechanism occurring to image the suspension segment shown. As the mechanism proceeds the effects described can be envisioned to compound their limitative effect, e.g., if a yellow particle 23 could not exchange charge due to blockage from effective contact with electrode 1, it would present a blue-light-absorbing barrier to other yellow particles attracted toward the charge exchange electrode. Also such yellow particles add color contamination to the blue (magentacyan) image formed by the unexposed particles.

Regardless of which one or more of the above contribute or control the migration limiting mechanism, I believe a limitation does exist as to maximum density which can be obtained in accordance with prior art procedures such as have been described. By the present invention I provide means and method to significantly reduce such limitation(s).

Specifically, I have provided means and method to substantially minimize the limiting effects described above. To do this I utilize means and procedure for increasing the non-imaged electrode surface, and in some embodiments the quantity of suspension, presented to the imaged electrode while the light image is being recorded thereon. A remarkable aspect of the present invention is that the foregoing can be accomplished by providing substantial relative movement between the electrodes' surfaces during imaging and that, although the image on the non-imaged electrode is elongated, the resulting image on the image electrode is of higher density and not smeared. It is to be noted that the non-imaged electrode envisioned in accordance with the present invention can be formed of materials known in the art as either injecting or blocking electrodes. However, other arrangements, e.g., ones in which the non-imaged "electrode" function is performed by a moving dispersion transport web which passes over a stationary electrode could be devised and should be deemed equivalent to the disclosed non-imaged electrode structures.

Figure 3:
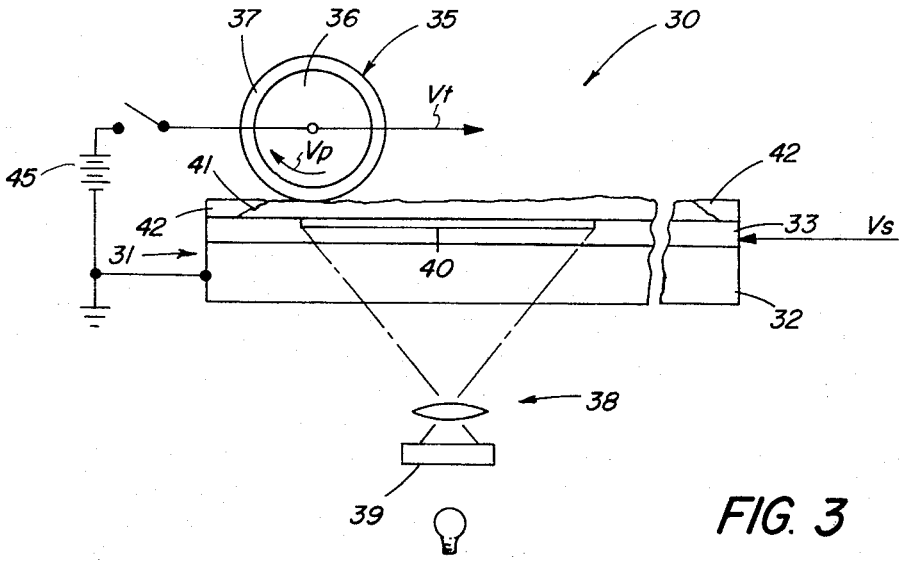
FIG. 3 is a schematic side view of one apparatus embodiment for photoelectrophoretic imaging in accordance with the present invention.
Figure 4:
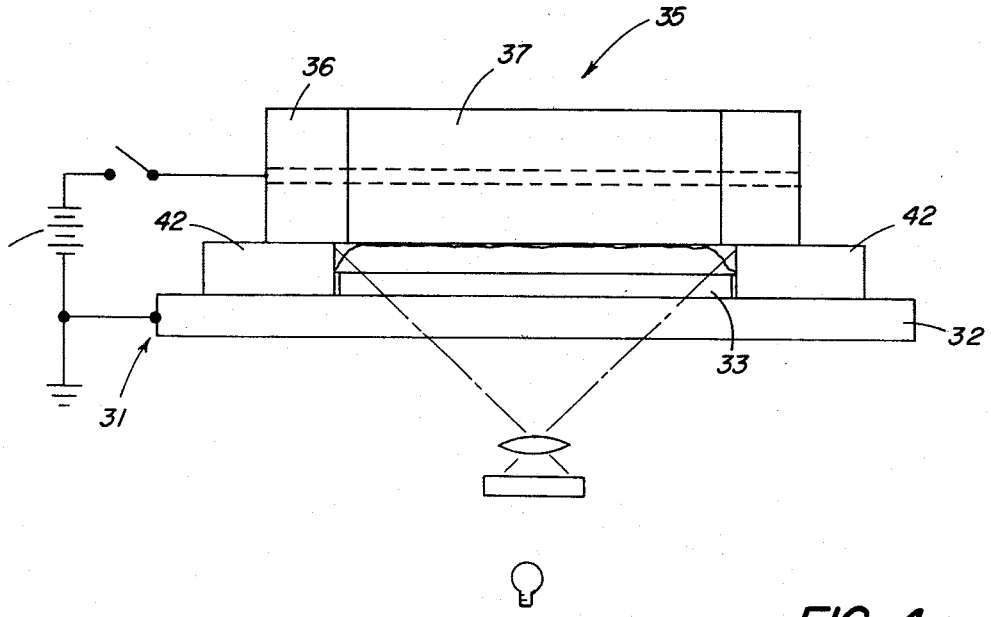
FIG. 4 is an end view of the FIG. 3 apparatus.

Referring now to FIGS. 3 and 4, one simplified embodiment for practice of the present invention is illustrated. The apparatus denoted generally 30 comprises a non-imaged electrode 31 having an electrically conductive, optically transparent support 32 and charge exchange layer 33. At least the portion 33 of the electrode 31 is longer than the dimension shown, as indicated by the omitted sector, for purposes hereinafter to be described. The image electrode 35 comprises a conductive roller portion 36 which can have an electrically insulative surface coating (not shown) and which supports a surface layer 37 which can be the copy sheet. An optical system 38 images a light image of an original 39 to be reproduced onto an image zone 40 within the electrophotosensitive pigment particle suspension 41 between the electrodes. Spacers 42 can be provided to maintain a gap between the electrodes. A source 45 of high voltage potential is applied between the electrodes. Electrode 35 is mounted for translation across the projected image at imaging zone 40 and for rotation in a clockwise direction, the rate and direction of roller translative velocity Vt and peripheral velocity Vp being such as to provide substantially zero relative velocity, or slipping, between the imaged electrode surface at the image zone and the contiguous light image portion focused in the plane within the suspension 41. Thus it can be seen that if as in the prior art, electrode 31 and the supported suspension 41 were stationary, no relative movement exists between them and each successively imaged portion of electrode 35.

However, in accordance with the present invention, at least the portion 33 of the non-imaged electrode 31 is moved at a velocity Vs in the direction opposite Vt so that substantial relative movement exists between the electrode surfaces at their field defining interface thereby substantially increasing the enlargement of the migration environment. That is, in the illustrated embodiment, the movement of electrode 31 can be controlled according to the criteria hereinafter described to simultaneously present fresh non-imaged electrode surface and suspension at the imaging zone, thus reducing the migration limiting effects described above and enhancing image density on the image electrode 35.

FIG. 6 discloses another embodiment of the present invention adapted to provide such controlled movement to the non-imaged electrode. The apparatus 30' is similar to that described with respect to FIGS. 3 and 4; however the non-imaged electrode surface comprises a continuous belt 33' moved around a path over electrode support and contact plate 32'. A uniform layer of dispersion 41 is supplied to the belt from supply 47, which can be configured as a conventional emulsion coating hopper at its outlet. Also a cleaning brush 48 can be provided to aid in removal of residual suspension from the electrode surface. The rate of movement of electrode belt 33' is controlled by drive motor 49 in a conventional manner. Imaged electrode 35 is supported for transversing and rotary movement by support rail 50 which can include a geared groove rack 51 cooperating with a gear configuration on the support shaft for electrode 35 to impart the desired transversing and rotary movement to the roller from drive source 55.

FIG. 5 discloses an alternative embodiment for implementing the present invention. In this apparatus 60, imaged electrode 61 is supported for rotation on a fixed axis 62. The non-imaged electrode 64 of this embodiment comprises a cylindrical drum which includes an inner shell 65 of electrically-conductive optically-transparent material and an outer shell 66 of transparent material. As shown electrode 64 also rotates on a fixed axis and is located so as to pass proximate electrode 61 in a manner defining an imaging zone therebetween. A reservoir 67 of dispersion 68 is provided so that roller 64, in its lower path, obtains a uniform layer of the suspension for transport to the imaging zone. Potential source 69 is connected to the electrodes to provide a migration inducing electrical field in the vicinity of the nip formed by the roller electrodes, i.e., so that the field extends throughout the imaging zone. A conventional scanning optical system, only a portion of which is illustrated, directs successive portions of the light image to be reproduced via mirror 70 and lens 71 into focus at the image zone. Such optical systems are conventional, e.g., such as shown and described in U.S. Pat. Nos. 3,609,028 and 3,628,859, and in operation provide a flowing sequence of discrete portions of the image to be reproduced at the image zone. In the FIG. 5 embodiment the successive image portions are projected in synchronization with the rotation of electrode 61, e.g., by timed movement of the original or of scanning mirrors and lenses, i.e., there should be substantially zero relative velocity between the portion of the imaged electrode 61 at the image zone and the aerial light image projected thereon. However, the drive 71 for non-imaged electrode 64 moves that electrode at a rate such that its peripheral velocity is substantially in excess of the peripheral velocity of electrode 61, thereby providing fresh electrode surface and dispersion during each successive image segment development stage. It will be noted that the movement of the electrode surfaces at their interface is in the same direction, in distinction to the embodiments shown in FIGS. 3, 4 and 6. In such a same-direction-mode it is necessary that the velocity of non-imaged electrode surface be greater than in the opposed-direction-modes, previously described, in order to obtain the equivalent enlargement of the migration environment; however it should be pointed out that any of the foregoing embodiments can be implemented in either the same direction or opposite direction modes if relative velocity of the electrodes is selected to present fresh electrode surface and dispersion at the proper rate. It is also to be noted that electrodes 61 and 64 can be chosen of materials suitable in character for providing the reproduction sense desired as output on the imaged electrode for either the PEP or PIER systems.

Having now described various exemplary structures for practice of the present invention, description of various specific applications of such structures will be useful to a further understanding of the invention and to provide teachings of useful and preferred relative velocity ranges for the invention.

EXAMPLE I

This test, which illustrates the use of the invention in a PIER system, was performed using the following materials and apparatus:

A dark charge exchange surface was prepared by coating Dispersion A given below, on the conductive surface of an electrode composed of a poly(ethylene terephthalate) film support bearing a thin, electrically conductive, substantially transparent, evaporated nickel overcoat having an optical density of 0.4.

Dispersion A 50.25 gm 2,4,7-trinitro-9-fluorenone (TNF)
80.40 gm Lexan® 145 Bisphenol-A polycarbonate sold by General Electric
2010.00 gm 60/40 mixture by weight of dichloromethane/1,2-dichloroethane
6.5%: total solids Dispersion A was coated on the electrode at a coverage of 0.325/gm/sq. ft. and dried. The dried coating was coated again with the same dispersion at the same coverage and dried to obtain a final dark charge exchange layer thickness of 5–10 microns.

A multicolor liquid imaging suspension was prepared by mixing together in equal volumes the following pigment dispersions:

Cyan Pigment Dispersion 0.5 gm: Cyan Blue GTNF
150 gm: admixture of equal parts by weight of Piccotex 100 and Isopar G®
Milling time — 30 days

Magenta Pigment Dispersion 0.5 gm: Watchung Red B
150 gm: admixture of equal parts by weight of Piccotex 100 and Isopar G®
Milling time — 30 days

Yellow Pigment Dispersion 0.6 gm: Indofast Yellow
150 gm: of an admixture composed of 2 parts by weight of Piccotex 100 to 3 parts by weight of Isopar G®
Milling time — 81 days The pigment dispersions were individually ball milled in 250 ml brown glass bottles each containing 635 gm of 0.32 cm diameter stainless steel balls. The milling rate was about 33 cm/sec.

The dark charge exchange surface as prepared above was used in a manual migration imaging apparatus similar to that illustrated in FIGS. 3 and 4. A dielectric paper covered, aluminum roller electrode was used to receive the unexposed migrated pigment particles and was spaced to a gap of about 50 microns above the dark charge exchange surface by inserting poly(ethylene terephthalate) film spacer strips at the edges of the roller between the dark charge exchange surface and the roller. The dielectric paper was a paper support coated with an insulating layer, with a dry thickness of about 10 microns, of poly (vinyl butyral) resin available from Shawinigan Products Corp. under the tradename of Butvar B-76.

Imaging was accomplished by simultaneously moving the paper covered roller electrode at a translational velocity of about 1.0 cm/sec across the dark charge exchange surface bearing a 0.001 inch to 0.002 inch thick layer of the multicolor liquid imaging suspension while pulling the dark charge exchange surface (by hand) in the opposite direction at a velocity of approximately 1.0 cm/sec, thus providing a migration environment of 2.0. At the same time an electrical potential of +1.6 Kv was applied to the roller and a 600 footcandle white light exposure was made through a positive color transparency to the liquid imaging suspension.

Observations

The multicolor positive image formed on the paper covered roller electrode was of high density and good quality. For comparison purposes, a control image was formed using the identical imaging method with the exception that the dark charge exchange surfaced electrode was held stationary. Average optical density measurements obtained from the test image and the control image are tabulated below:

| IMAGE | RED DENSITY | BLUE DENSITY | GREEN DENSITY |
|---|---|---|---|
| Control | .25 | .35 | .35 |
| Test | .50 | .65 | .75 |

EXAMPLE II

A dark charge exchange surface was prepared as described in Example I.

A cyan pigment dispersion was prepared from the following formulation:

0.7 gm: Cyan Blue GTNF
150 gm: admixture of equal parts by weight of Piccotex 100 and Isopar G®
Milling time — 28 days The cyan pigment dispersion was ball milled in a 250 ml brown glass bottle filled with 625 gm of 0.32 cm diameter stainless steel balls.

Imaging was accomplished as described in Example I, except that the exposure was made through a red Kodak Wratten Filter No. 29.

Observations

The test image formed on the paper covered roller electrode was a positive and the measured average red density was higher than the density of a control image formed by holding the dark charge exchange surface-imaging electrode stationary.

| Image | Average Red Density |
|---|---|
| Control | 0.45 |
| Test | 0.75 |

EXAMPLE III

This example was designed to show that the density of a PIER image is a function of the relative velocity between the imaged and the non-imaged electrode surfaces.

A dark charge exchange surface was prepared as described in Example I. A bottle of cyan dispersion described in Example I was prepared. To this dispersion about 5 ml of Isopar G® was added after the 30 day milling period to reduce dispersion viscosity. Imaging was accomplished using a processing configuration similar to that shown in FIG. 5 except that the charge exchange electrode was fed from a supply to a take-up roller in the same direction as the translation of the imaged electrode, i.e., same direction mode of operation. Also the dispersion was hand applied as in Example I. The test object consisted of a 1 cm × 1.2 cm black patch having clear background. A Carousel projector provided a 1200 fc light intensity at the plane of the test object. The light exposure was 1200 fc (white tungsten) through a red Kodak Wratten Filter No. 29, through a black and white transparency and then through the 0.4 ND Ni support of the dark charge exchange surface. The roller receiver was held at an electrical potential of about +1.5 KV.

A series of prints were made with a roller translational velocity and roller peripheral velocity Vp of about 0.71 cm/sec. Prints were made at dark charge exchange, i.e., non-imaged electrode, lateral velocities Vs of 0, 1.65 cm/sec, 2.2 cm/sec, 2.3 cm/sec, 2.9 cm/sec, 3.3 cm/sec, and 3.8 cm/sec.

Another series of prints using the above-mentioned cyan dispersion diluted 1:1 by volume with Isopar G® were made at velocities Vs of 3.4 cm/sec, 5.08 cm/sec and 6.4 cm/sec. For this series of images the roller translational velocity Vt and peripheral velocity Vp were 1.4 cm/sec.

Observations

The images formed on the paper (Type III) covered roller receiver electrode had the same image sense as the original test object. The measured average image densities of the block pattern image formed at each surface velocity are tabulated in Table II for the 0.71 cm/sec roller velocity and in Table III for the 1.4 cm/sec roller velocity.

Table II

| Surface Velocity | Avg. Red Density |
|---|---|
| 1.65 cm/sec | 0.75 |
| 2.2 | 1.00 |
| 2.3 | 0.90 |
| 2.9 | 1.1 |
| 3.3 | 1.20 |
| 3.8 | 1.40 |
| 3.8 | 1.45 |

Table III

| Surface Velocity | Avg. Red Density |
|---|---|
| 3.4 | 1.10 |
| 5.1 | 1.55 |
| 5.1 | 1.60 |
| 6.4 | 1.80 |

The maximum density ($D_{max}$) as a function of surface velocity $V_S$ for each roller translational velocity $V_t$ is plotted in FIG. 7. The maximum density as a function of migration environment enlargement is plotted in FIG. 8.

EXAMPLE IV

This example was designed to illustrate the formation of high density three color PIER images using moving surface processing. The same apparatus described in Example III was used but in opposed-direction-mode.

In this example the test object was a color transparency which includes cyan, magenta, yellow, and neutral patches. The exposure entering the test object was about 1500 fc originating from a Carousel projector.

A trimix liquid imaging suspension was prepared by mixing together the following pigment dispersions:

Cyan Pigment Dispersion 4.0 gm of cyan particles composed of the beta form of copper phthalocyanine, C.I. No. 74160, available from American Cyanamid under the trade name of Cyan Blue GTNF.

450 gm of a mixture of a styrene-vinyl toluene copolymer (available under the trade name of Piccotex 120 from Pennsylvania Industrial Chemical Corp.) and an isoparaffinic aliphatic hydrocarbon liquid sold under the trade name Isopar G® by Exxon Corp. of New Jersey. This 450 gm admixture consists of the ratio 180/270 of Piccotex 120 and Isopar G®.

The cyan pigment dispersion was ball milled for about 6 weeks in 950 ml brown glass bottles half filled with 0.32 cm diameter stainless steel balls. The bottle surface milling velocity was about 22.5 m/min.

Magenta Pigment Dispersion 1.0 gm magenta particles composed of Watchung Red B, a barium salt of 1-4'-methyl-5'-chloro-azobenzene-2'-sulfonic acid)-2-hydroxy-3-naphthoic acid, C.I. No. 15865, available from E. I. DuPont de Nemours and Co.

150 gm mixture of Piccotex 100 and Isopar G® consisting of equal parts.

The magenta pigment dispersion was ball milled for about 4 weeks in 250 ml brown glass bottles filled with 635 gm of 0.32 cm diameter stainless steel balls. The bottle surface milling velocity was about 22.5 m/min.

Yellow Pigment Dispersion 1.5 gm of yellow particles composed of a flavanthrone pigment, C.I. No. 70600, available from Harmon Colors Co. under the trade name of Indofast Yellow.

150 gm of 2 parts by weight of Piccotex 100 to 3 parts by weight of Isopar G®.

The preparation was the same as the magenta pigment dispersion except the dispersion was milled for 8 weeks.

The final trimix liquid imaging suspension was prepared by mixing the above C, M, Y dispersions in the ratio 1/1/1 by volume.

Observations

The results of this example are summarized in FIG. 9. $D_{max}$ for the cyan, magenta, yellow and neutral patches were plotted as a function of migration environment enlargement. For each color, the density increased with increasing environment enlargement. It was also observed that improved background ($D_{min}$) occurred using moving surface processing compared to prints formed at an environment enlargement of 1.0 as used in prior art devices. In addition it was observed that less exposure is required in moving surface processing.

EXAMPLE V

This example was designed to illustrate the utility of enlarged migration environment processing in PEP migration imaging. This example utilizes a negatively biased roller receiver which allows a positive image reproduction to be formed on the image electrode.

A cyan monocolor dispersion was prepared as follows:

Cyan Pigment Dispersion 0.5 gm Cyan Blue GTNF pigment particles
150 gm Isopar G®

It should be noted that no polymer is incorporated in the carrier liquid as in the previous examples. The dispersion was prepared as described for the magenta dispersion described in Example IV.

The non-imaged electrode comprised a poly(ethylene terephthalate) film support bearing a thin, electrically conductive, substantially transparent, evaporated nickel overcoat having an optical density of 0.4.

Imaging was accomplished using the opposed-mode processing and the apparatus configuration described in Example IV. The test object consisted of a black-and-white transparency having clear letter areas. A Carousel projector provided a 2000 fc light intensity. The exposure was filtered through a Kodak Wratten Filter No. 29 and the 0.4 ND Ni support.

In this example, the paper covered roller receiver, image electrode, was held at an electrical potential of about −1.5 KV, so that initially positively charged particles were first attracted to the image electrode.

A series of prints were made with a roller velocity of about 0.7 cm/sec at various lateral velocities of the Ni electrode. The procedure was similar to Example III.

Observations

The cyan images formed on the paper covered roller electrode had the same image sense as the original test object. The measured average image densities of the roller image formed at each surface velocity are plotted in FIG. 10. The data points showed scatter but the trend of the data shows higher image densities at higher relative velocities. It is also significant to note that the present invention serves to provide reduced background densities compared, e.g., an enlargement environment of 1.0. This effect is believed to be caused by the removal of activated particles by the non-image electrode before a second charge exchange occurs.

Considering the foregoing Examples and my other work with the present invention, it appears that image density will increase in proportion to the increase in enlargement of the migration environment. Optimum ranges of such enlargement will depend to some extent on the image and background densities desired from a system and upon other system parameters such as the concentration of marking particles in the image dispersion and thickness of the dispersion layer. In some applications an image density of 1.0 has been found acceptable; and in monocolor dispersions, it has been shown above that an enlargement of about 1.5 can provide this result. The significant factor is that some substantial enlargement be provided. For trimix dispersions higher environment enlargements would normally be utilized as can be seen from FIG. 9. In a system using dispersions of concentrations such as described in the foregoing Examples, I have found an enlargement of migration environment of about 3 to be highly desirable for monocolor imaging while a higher enlargement of about 5 to be preferred for tricolor dispersions. The upper enlargement limit for practice of the invention thus far appears to be only a matter of machine construction.

Figure 11:
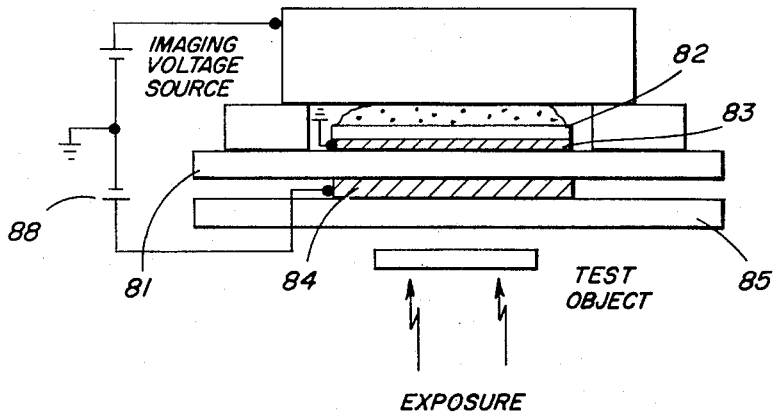
FIG. 11 is a schematic end view of a web electrode apparatus for practice of the present invention incorporating an improved structure minimizing electrode rubbing.

For example, FIG. 11 illustrates an embodiment of the present invention incorporating an improved feature for minimizing rubbing between electrodes in implementations where such phenomenon occurs and is detrimental.

Specifically, it was observed that in certain moving surface processing apparatus configuration considerable rubbing may occur during processing between the roller receiver and the moving charge exchange electrode surface. Since relative motion is required between both electrodes for effective moving surface processing, the rubbing can result in abraided and smeared images on the roller receiver.

The cause for such rubbing is believed to be the electrostatic force of attraction between the oppositely biased electrodes, i.e., an electrostatic force of attraction between the positive biased roller receiver and the negative biased charge exchange electrode pulls both electrodes together resulting in rubbing.

The apparatus shown in FIG. 11 obviates this problem by providing a counter force which reduces the force of attraction between the electrodes. The counter force is provided by applying an electrostatic voltage between the semitransparent conducting support layer 83 of the moving charge exchange electrode 82 and an additional semitransparent conducting layer 84 positioned on a support 85 below the glass support 81 of layer 82. The polarity of this counter voltage 88 is chosen so that the additional conducting layer 84 is positive with respect to the charge exchange electrode 82. In this manner an electrostatic force of attraction exists between these two electrodes which is directed opposite to the electrostatic force existing between the roller receiver and the charge exchange electrode. Thus by adjusting the counter voltage source a voltage is obtained above which no force of attraction is observed between the roller and DCES during processing.

The invention has been described in detail with particular reference to certain preferred embodiments thereof, but it will be understood that variations and modifications can be effected within the spirit and scope of the invention.

I claim:

1. Improved apparatus for depositing electrophotosensitive pigment particles in an image pattern corresponding to an original to be reproduced, said apparatus comprising:

(a) an imaged electrode having a surface on which such image pattern is to be formed;

(b) a non-imaged electrode spaced adjacent said imaged electrode in a manner forming an imaging zone therebetween;

(c) means for creating an electrical field across said electrodes at said imaging zone;

(d) means for supplying, between said electrodes, a dispersion containing electrophotosensitive pigment particles;

(e) means for imaging a radiation pattern representative of the original to be reproduced onto dispersion between said electrodes; and (f) means for controlling movement simultaneously of both said electrodes and said imaging means during an image forming operation such that a substantially zero relative velocity exists between said imaged electrode and the radiation pattern at said imaging zone and a substantially enlarged migration environment is presented to said image electrode during an imaging cycle.

2. The invention defined in claim 1 wherein said moving means provides a migration environment enlargement of at least about 1.5.

3. The invention defined in claim 1 wherein the dispersion provided by said supply means is a monocolor particle dispersion and said moving means provides a migration environment enlargement of at least about 3.0.

4. The invention defined in claim 1 wherein the dispersion provided by said supply means is a tricolor particle dispersion and said moving means provides a migration environment enlargement of at least about 5.0 between said electrodes.

5. In electrophoretic migration imaging apparatus of the type having an imaged member, means for generating a radiation pattern representative of an image to be produced, a non-imaged member, means for providing a dispersion of electrophotosensitive particles between said members, means for providing an electrical field across said members, and means for controlling at least one of said imaged member and said pattern generating means so that successive portions of said pattern are presented sequentially, with substantially no relative movement, to successive portions of said imaged member, the improvement comprising:

means for controlling the relative movement of said imaged and non-imaged electrodes so that a substantially enlarged migration environment is provided for said imaged member during presentation of said radiation pattern.

6. The invention defined in claim 5 wherein said moving means provides a migration environment enlargement of at least about 1.5.

7. The invention defined in claim 5 wherein the dispersion provided by said supply means is a monocolor particle dispersion and said moving means provides a migration environment enalrgement of at least about 3.0.

8. The invention defined in claim 5 wherein the dispersion provided by said supply means is a tricolor particle dispersion and said moving means provides a migration environment enlargement of at least about 5.0.

9. In electrophoretic migration imaging apparatus of the type having imaged and non-imaged electrodes, an optical system and control means which cooperate during an imaging cycle in a manner such that successive incremental portions of a radiation pattern, corresponding to portions of an original to be reproduced, are presented respectively between successive incremental portions of the imaged and non-imaged electrode with a substantially zero relative velocity between said pattern and imaged electrode portions, and including means for providing electrophotosensitive pigment particles between such electrode portions and means for creating a migration inducing field between such electrode portions, the improvement wherein said control means comprises electrode transport means for providing a substantially enlarged migration environment to said imaged electrode.

10. The invention defined in claim 9 wherein said non-imaged electrode is moved at a substantially greater velocity than said imaged electrode.

11. The invention defined in claim 9 wherein said pigment providing means supplies pigment dispersion to said non-imaged electrode surface.

12. The invention defined in claim 9 wherein said non-imaged electrode is in the form of an elongated web.

13. The invention defined in claim 9 wherein said non-imaged electrode is in the form of a generally cylindrically-shaped drum.

14. The invention defined in claim 9 wherein said transport means moves said imaged and non-imaged electrodes in opposite directions.

15. The invention defined in claim 9 wherein said imaged electrode is cylindrical and mounted for rolling movement across a planar image projection and transport means moves said non-imaged electrode in the same direction as the translational movement of said imaged electrode but at a linear velocity which is at least 1.5 times the translational velocity of said imaged electrode.

16. The invention defined in claim 9 wherein said imaged and non-imaged electrodes are cylindrically-shaped and the peripheral velocity of said non-imaged electrode is at least 1.5 times the peripheral velocity of said imaged electrode.

17. The invention defined in claim 9 further including means for reducing the electrostatic attractive force between said imaged and non-imaged electrodes.

18. A method of electrophoretic migration imaging comprising:

(a) providing an imaged and non-imaged electrode in spaced relation with an imaging dispersion of electrophotosensitive pigment particles therebetween and an electrical field thereacross for producing a migration of imaging particles; and (b) directing a radiation pattern corresponding to an image to be reproduced onto said imaged electrode with a substantially zero relative velocity therebetween, while providing a substantially enlarged migration environment to said imaged electrode.

19. The invention defined in claim 18 wherein said environment enlargement is at least about 1.5.

20. The invention defined in claim 18 wherein said dispersion is monocolor and said environment enlargement is at least about 3.0.

21. The invention defined in claim 18 wherein said dispersion is a tricolor one and said environment enlargement is at least about 5.0.

22. In electrophoretic migration imaging apparatus of the type having an imaged member, means for generating a radiation pattern representative of an image to be produced, a non-imaged member, means for providing a dispersion of electrophotosensitive particles between said members, means for providing an electrical field across said members, and said pattern generating means so that successive portions of said pattern are presented sequentially, with substantially no relative movement, to successive portions of said imaged member, the improvement wherein said dispersion providing means feeds dispersion past said image member at a rate faster than the rate of presentation of said image pattern.

23. In electrophoretic migration imaging apparatus of the type having an imaged member, means for generating a radiation pattern representative of an image to be produced, a non-imaged member, means for providing a dispersion of electrophotosensitive particles between said members, means for providing an electrical field across said members, and means for controlling at least one of said imaged member and said pattern generating means so that successive portions of said pattern are presented sequentially, with substantially no relative movement, to successive portions of said imaged member, the improvement comprising:

means for controlling the relative movement of said imaged and non-imaged electrodes so that the non-image member is moved past said image member at a rate faster than the presentation of said radiation pattern.

* * * * *